US008689369B2

(12) United States Patent
Nelson

(10) Patent No.: US 8,689,369 B2
(45) Date of Patent: Apr. 8, 2014

(54) POOL SKIMMER WITH INTEGRAL DISINFECTANT DISPENSER

(75) Inventor: Laurence A. Nelson, Knoxville, TN (US)

(73) Assignee: P.I. Inc., Athens, TN (US)

( * ) Notice: Subject to any disclaimer, the term of this patent is extended or adjusted under 35 U.S.C. 154(b) by 84 days.

(21) Appl. No.: 12/621,046

(22) Filed: Nov. 18, 2009

(65) Prior Publication Data

US 2010/0125942 A1 May 27, 2010

Related U.S. Application Data

(60) Provisional application No. 61/115,599, filed on Nov. 18, 2008.

(51) Int. Cl.
*E04H 4/00* (2006.01)

(52) U.S. Cl.
USPC ..... 4/507; 4/509; 4/508; 4/496; 210/169; 210/416.7; 210/416.2

(58) Field of Classification Search
USPC ..... 4/487–513
See application file for complete search history.

(56) References Cited

U.S. PATENT DOCUMENTS

| | | | | |
|---|---|---|---|---|
| 3,508,661 | A * | 4/1970 | Gershman et al. | 210/167.12 |
| 4,801,378 | A * | 1/1989 | Desjoyaux et al. | 210/167.2 |
| 5,474,673 | A * | 12/1995 | Ludlow | 210/151 |
| 6,138,294 | A * | 10/2000 | Desjoyaux et al. | 4/509 |
| 6,187,181 | B1 * | 2/2001 | Stoltz et al. | 210/122 |
| 6,951,608 | B2 * | 10/2005 | Desjoyaux et al. | 210/167.19 |
| 2006/0163132 | A1 * | 7/2006 | Kelty | 210/169 |
| 2006/0242757 | A1 * | 11/2006 | Goettl | 4/507 |
| 2007/0187311 | A1 * | 8/2007 | Braun et al. | 210/167.1 |

* cited by examiner

*Primary Examiner* — Jason J Boeckmann
*Assistant Examiner* — Joel Zhou
(74) *Attorney, Agent, or Firm* — Mark J. Nahnsen; Barnes & Thornburg LLP

(57) ABSTRACT

A swimming pool skimmer formed to include an integral disinfectant dispenser. The disinfectant dispenser is adapted to enable infinite adjustment to the level of disinfectant dispensed into the normal flow of the pool water. The skimmer includes a valve that is used to adjust the flow of water distributed to the disinfectant dispenser. The flow rate of water entering the dispensing chamber is controlled by the valve, which controls the water level within the dispensing chamber. The amount of water exiting the dispensing chamber is controlled by a vertically extending elongated flow slit. The higher the water level in the dispensing chamber causes more exposure to the chlorine tablets, increasing the chlorine level in the dispensing water. Chlorinated water exits the flow slit and enters the skimmer main chamber.

9 Claims, 12 Drawing Sheets

POOL SKIMMER WITH INTEGRAL DISINFECTANT DISPENSER

The present application claims priority to U.S. Provisional Patent Application Ser. No. 61/115,599 filed on Nov. 18, 2008, which is herein incorporated by reference.

BACKGROUND

Introduction

The present disclosure relates to swimming pool skimmer with integral disinfectant dispensing capability and particularly to an adjustable chemical dispensing capability. In the art of cleansing or purifying the water of a swimming pool, it is common practice to incorporate a feeder of purifying chemicals, such as chlorine in tablet form, in the closed system for the purpose of feeding the purifying chemicals in solution to the swimming pool water.

A swimming pool skimmer includes a pressure chamber connected to a pump return. Water is discharged from the pressure chamber, through a nozzle located immediately below the surface water intake of the skimmer, and induces a strong counter-current flow toward the skimmer, with an attendant multiplication of the skimmer's zone of influence. A dispenser of purifying chemicals may be combined with the skimmer. Water under pressure is supplied to the dispensing chamber whenever the pump, and hence the skimmer is in operation. As a consequence, the water level in the dispensing chamber is raised to cause immersion and dissolution of the chemicals, and their spill-over while in solution into the water passing through the skimmer. When the pump is not operating, the water level of the dispensing chamber drops below the chemicals receiver. The chemicals thus dissolve only when the pump and skimmer are operating. U.S. Pat. No. 3,765,534 generally discloses this type of skimmer and is incorporated by reference herein.

SUMMARY

According to the present disclosure a swimming pool skimmer with integral disinfectant dispensing capability is adapted to enable infinite adjustment to the amount of disinfectant dispensed into the normal flow of the pool water.

In illustrative embodiments, the swimming pool skimmer with integral disinfectant dispensing capability includes a valve to adjust the flow of water distributed to the disinfectant dispenser. The flow rate of water entering the dispensing chamber is controlled by the valve to control the water level within the dispensing chamber. The amount of water exiting the dispensing chamber is controlled by a vertically extending elongated flow slit. The higher the water level in the dispensing chamber causes more exposure to the chlorine tablets, increasing the chlorine level in the dispensing water. Chlorinated water exits the flow slit and enters the skimmer main chamber.

In illustrative embodiments, the skimmer includes overflow that is positioned in a generally vertical orientation. Since the overflow is vertically oriented overflow tubes of differing length can be inserted to allow for the adjustment of the water level of the pool if required. Use of longer overflow tubes increases the water level in the pool. Use of shorter overflow tubes has an opposite effect.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
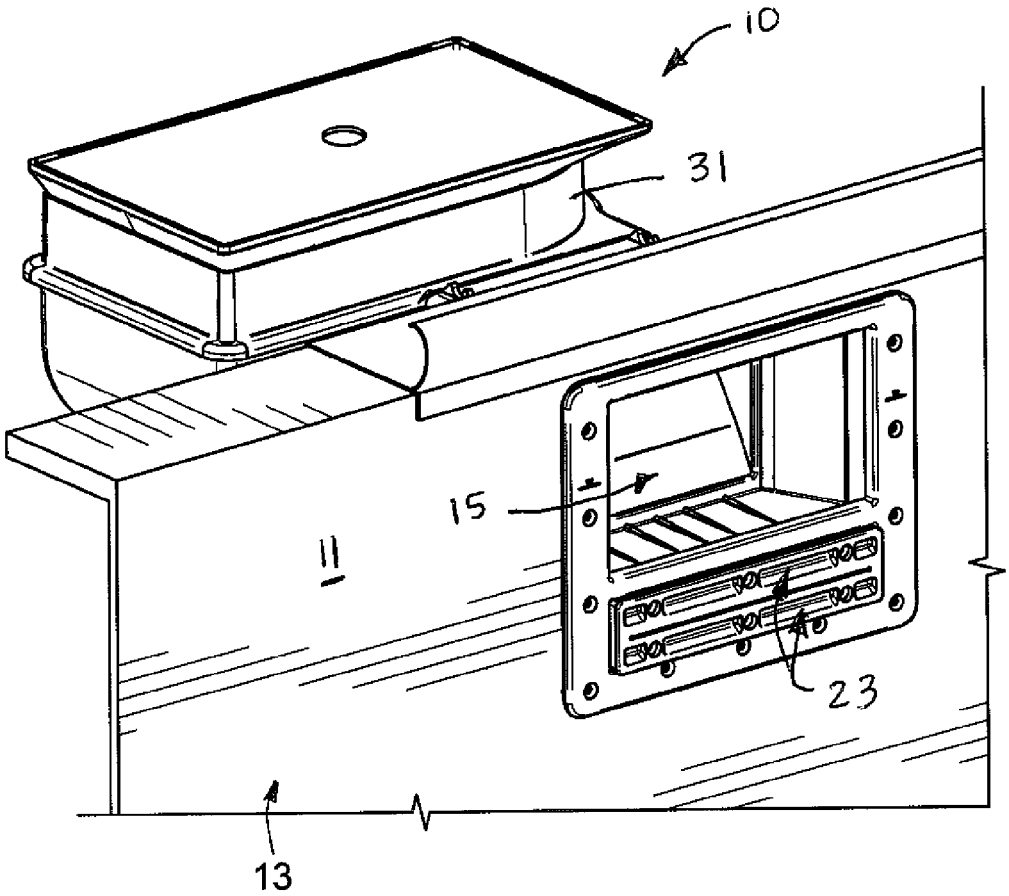
FIG. 1 is a front perspective view of the side wall of a pool having a pool skimmer secured to the side wall of the pool.
Figure 2:
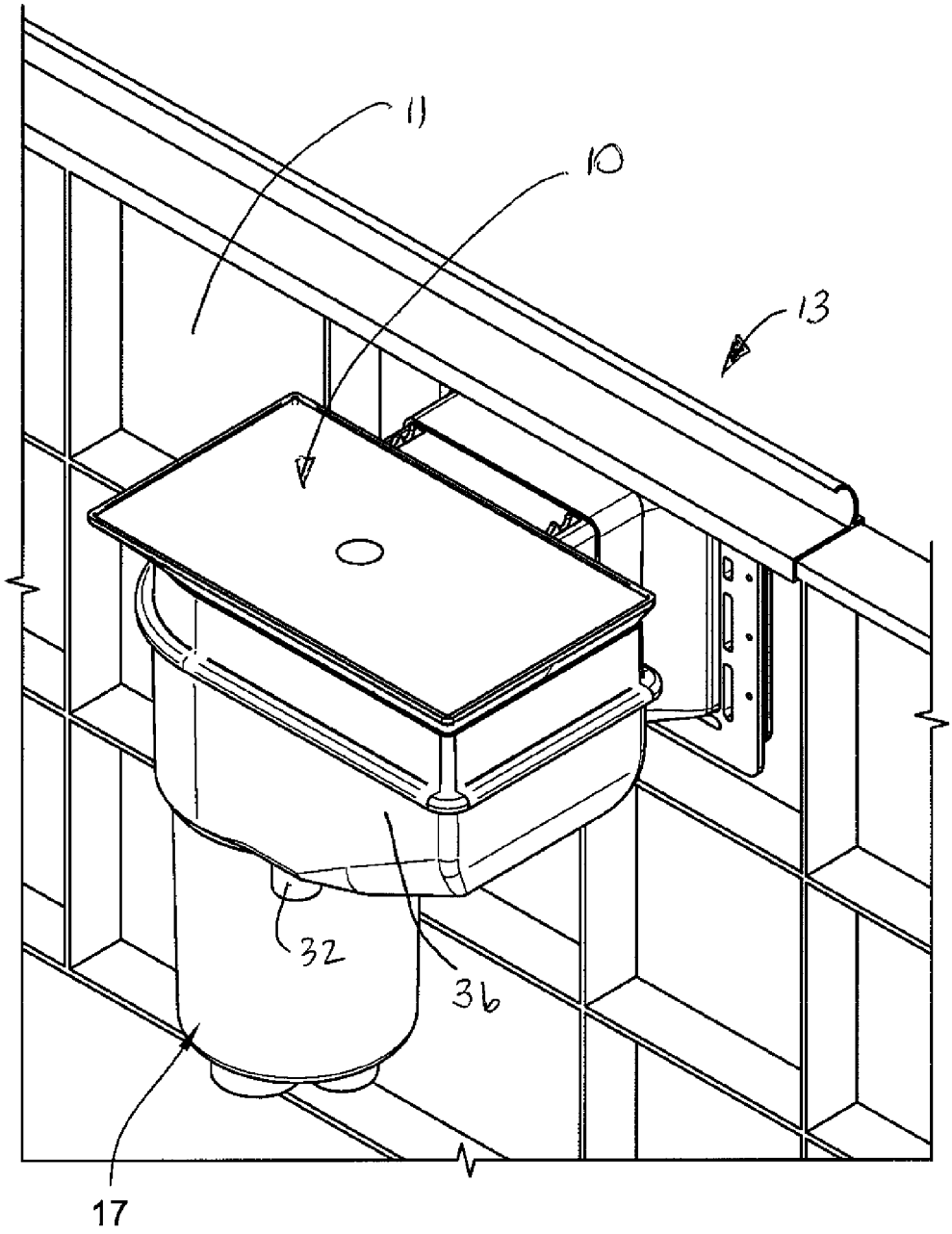
FIG. 2 is a rear perspective view of the side wall of a pool having a pool skimmer secured to the side wall of the pool.

While the present disclosure may be susceptible to embodiment in different forms, there are shown in the drawings, and herein will be described in detail, embodiments with the understanding that the present description is to be considered an exemplification of the principles of the disclosure and is not intended to limit the disclosure to the details of construction and the arrangements of components set forth in the follow description or illustrated in the drawings.

Figure 3:
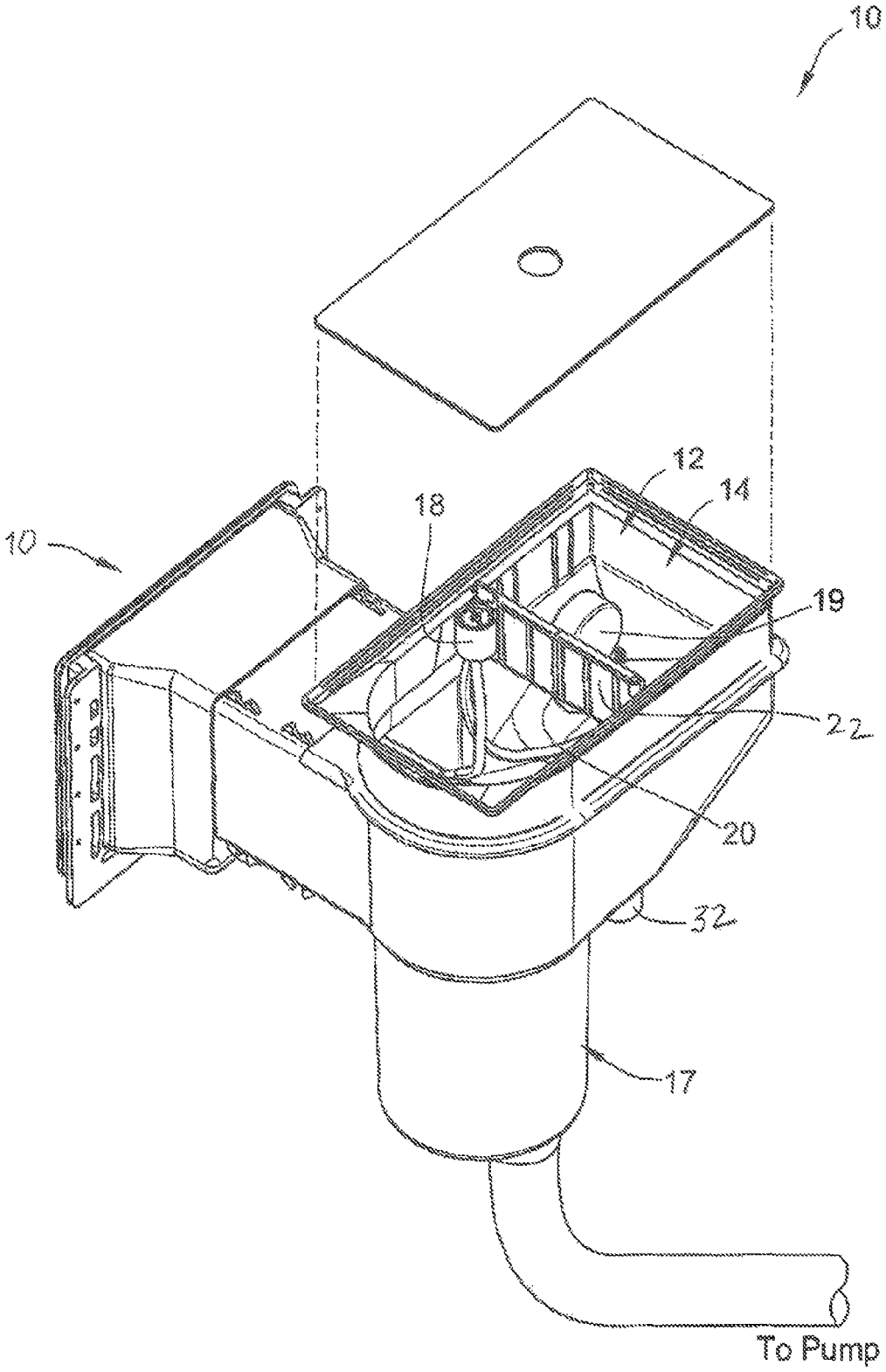
FIG. 3 is a perspective view showing the skimmer cover raised to show the valve assembly that controls the water flow to the disinfectant dispenser chamber.
Figure 4:
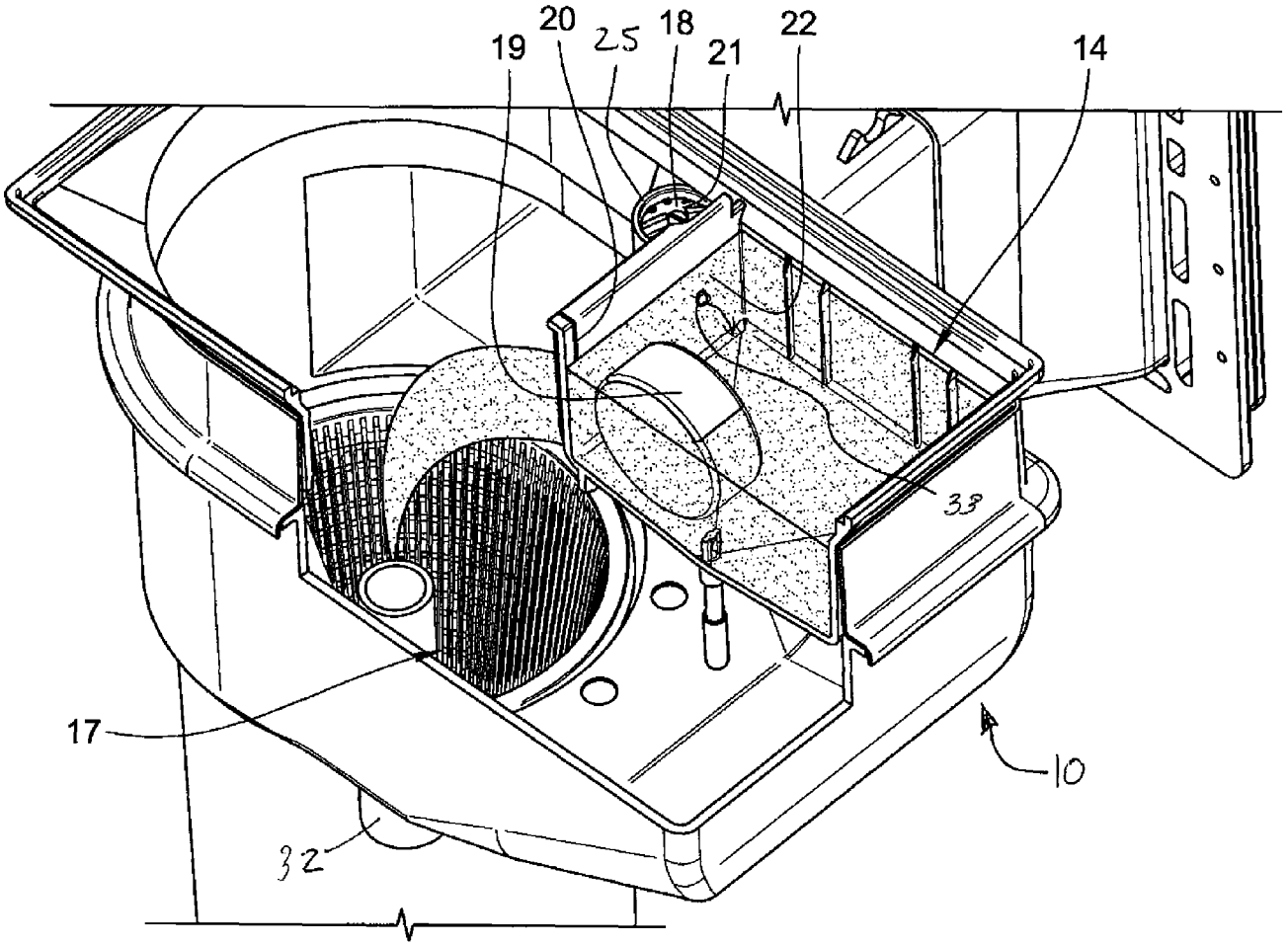
FIG. 4 is a perspective view of the disinfectant dispenser chamber with a high water level and high disinfectant flow into the main skimmer chamber.

In an illustrative embodiment, swimming pool skimmer 10 is provided with an integral disinfectant dispensing capability. The skimmer 10 is attached to the sidewall 11 of a pool 13, as shown in FIG. 1. The skimmer 10 includes a housing 31 an intake 15 which flows into a strainer basket 17, as shown in FIG. 4. The skimmer 10 also includes a plenum 23, which returns pressurized water from the pump (not shown) to the pool 13. Swimming pool skimmer 10 includes a treatment system 12 that includes a disinfectant chamber 14, which is adapted to contain a chlorinated treatment cartridge (not shown) containing chlorinated tablets 19, as shown in FIG. 3. While chlorine tablets 19 are shown, it is contemplated that other water treatment products could also be used including sodium tablets, etc. The treatment system 12 includes a flow-control valve 18 that is configured to adjust the flow of untreated water entering the disinfectant chamber 14.

Figure 5:
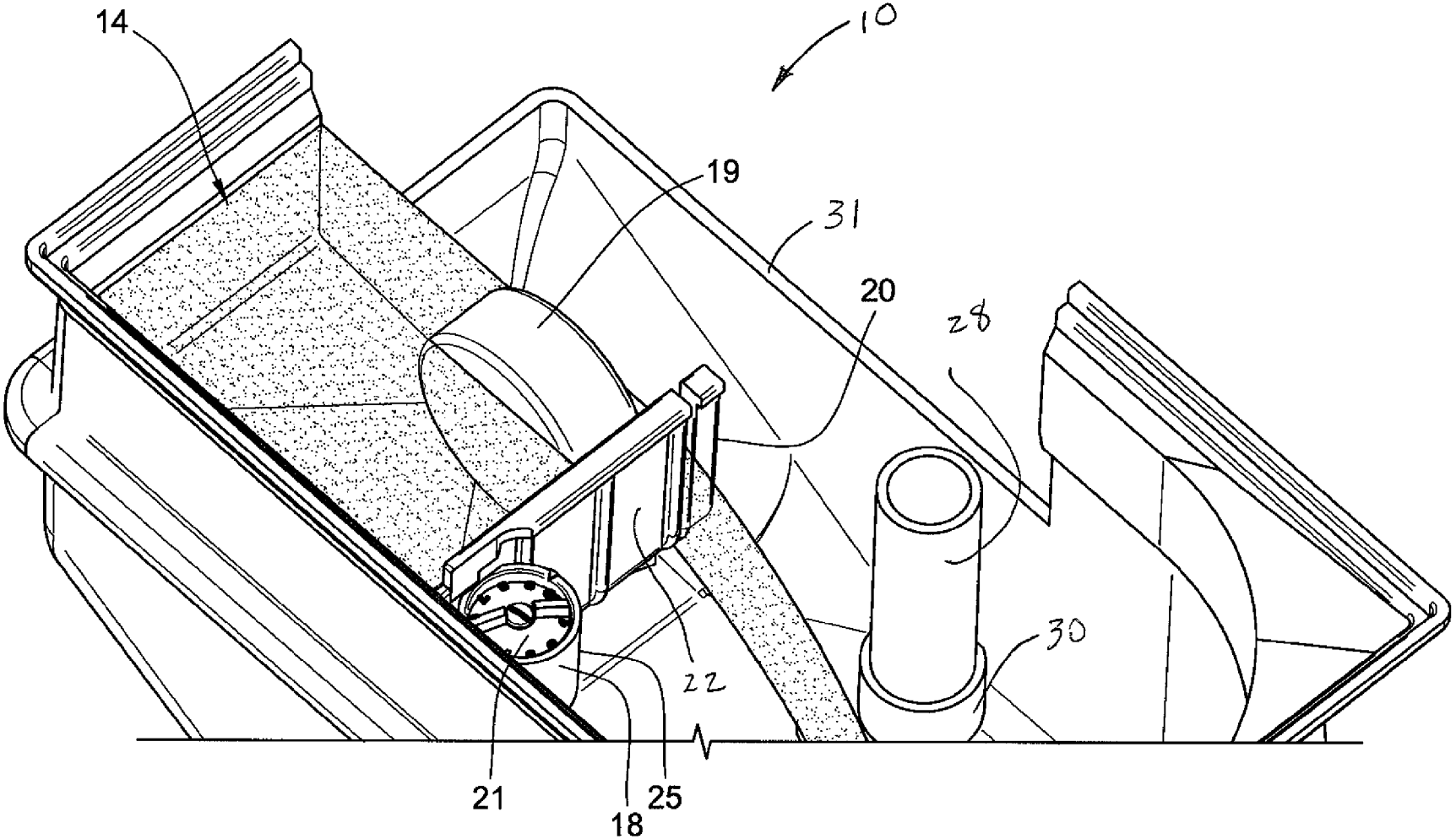
FIG. 5 is a perspective view showing the valve set at a high setting and the high water level and high disinfectant flow into the skimmer chamber.

The flow-control valve 18, in the illustrative embodiments, includes a tubular housing 25 and a rotary dial 21 having indicia such as the numbers 0-9, as shown in FIGS. 4 and 5.

The dial 21 controls the flow of water through the valve 18 by increasing and decreasing the cross-sectional area of the water flow path within the valve 18. The housing 25 can be molded with the skimmer 10 or can be a separate component. The housing is connected to the disinfectant chamber 14 by a passageway 33.

The disinfectant chamber 14 includes an exit port in the form of a narrow vertically oriented flow slit 20 running from the top to the bottom of a side wall 22 of disinfectant chamber 14. The exit port allows water to exit the disinfectant chamber 14 at a controlled rate. In this embodiment, both the rate of water flow entering disinfectant chamber 14 and the water level are controlled by the flow-control valve 18. This arrangement allows for a wide range of adjustment in the amount of chlorine that is dispensed from the disinfectant chamber 14 through the flow slit 20.

Figure 6:
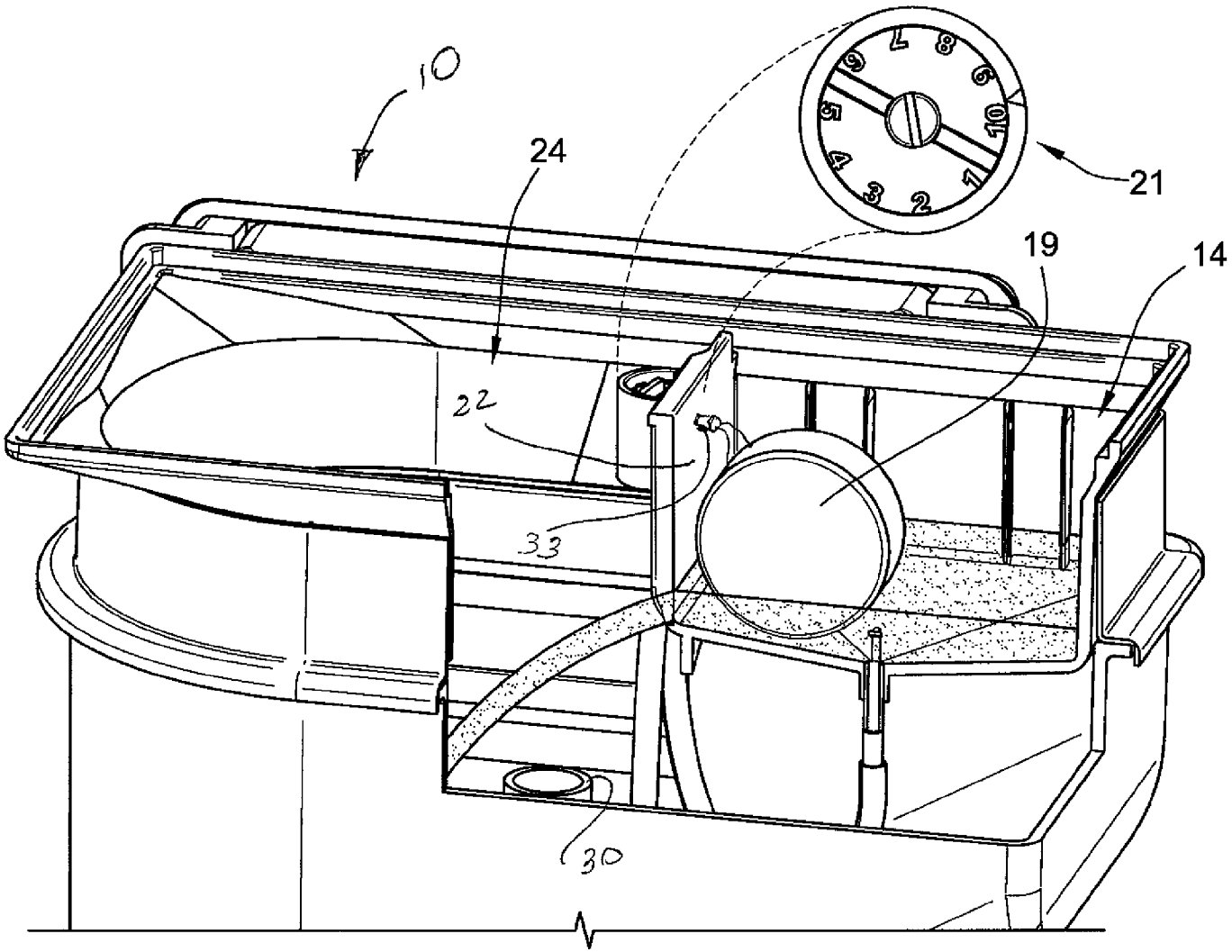
FIG. 6 is a perspective view of the disinfectant dispenser chamber with a low water level and low disinfectant flow into the skimmer chamber.
Figure 7:
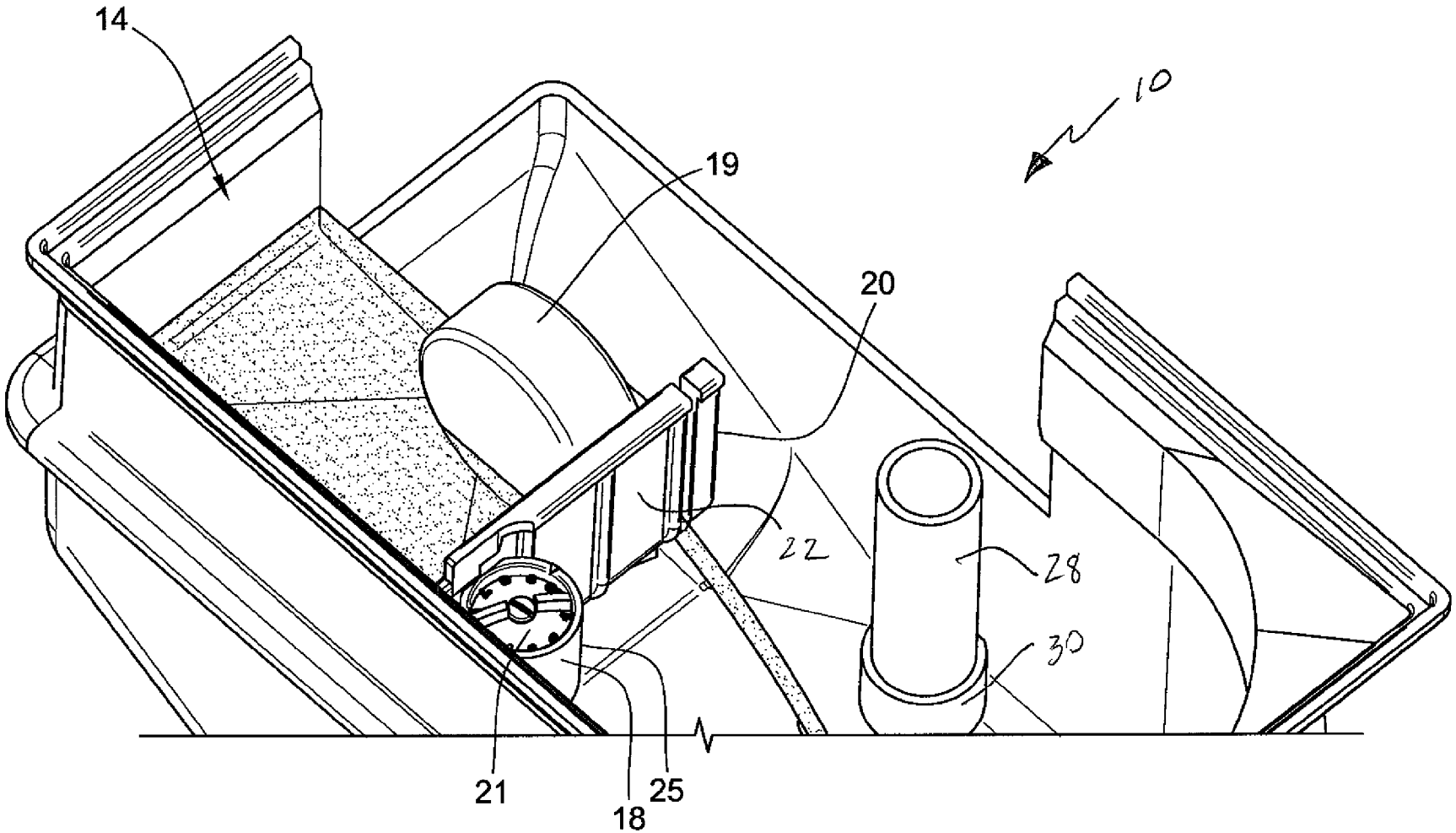
FIG. 7 is a perspective view showing the valve set at a high setting and the low water level and low disinfectant flow into the skimmer chamber.
Figure 8:
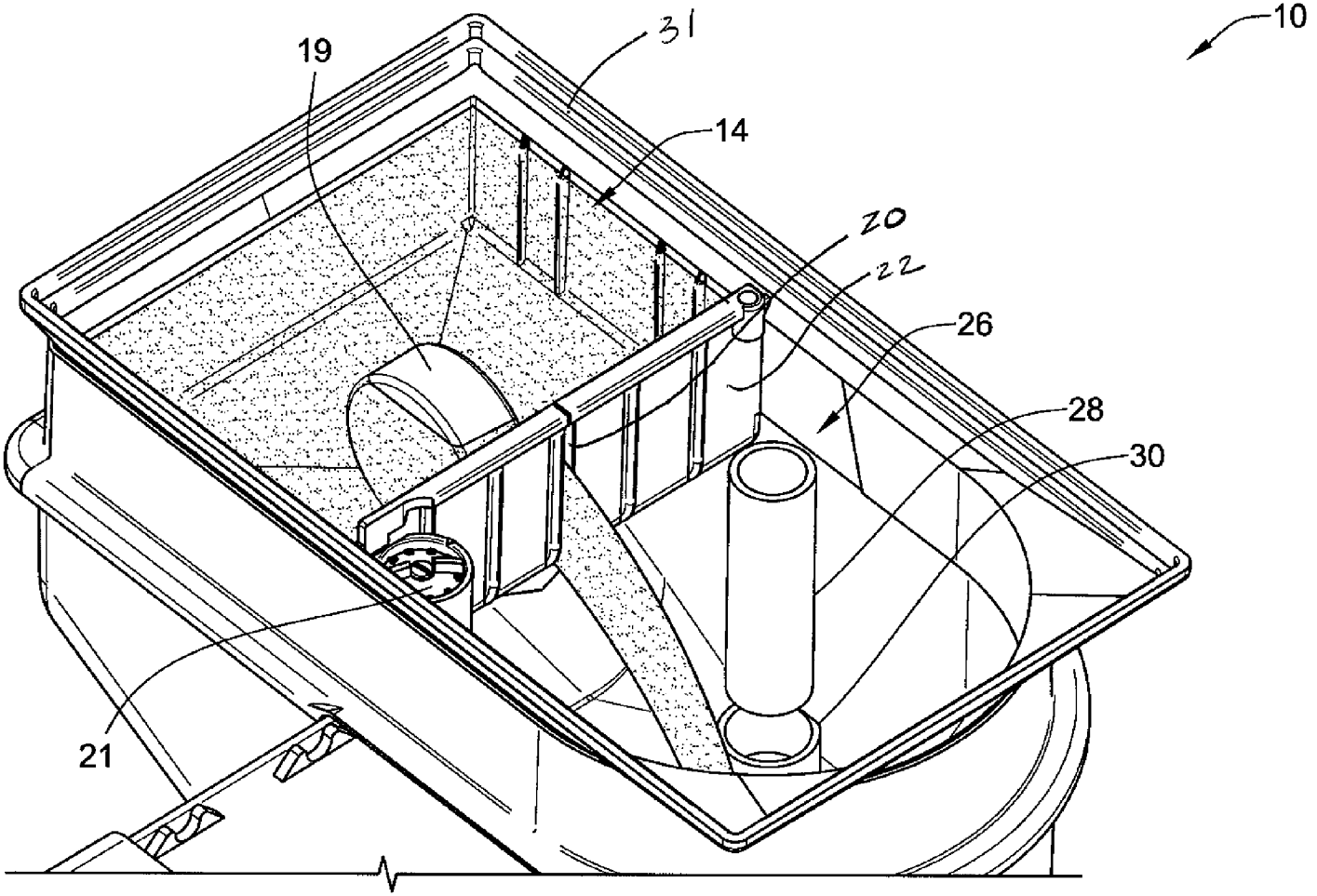
FIG. 8 is an exploded view of the overflow tube and the receiving boss in the main skimmer chamber.
Figure 9:
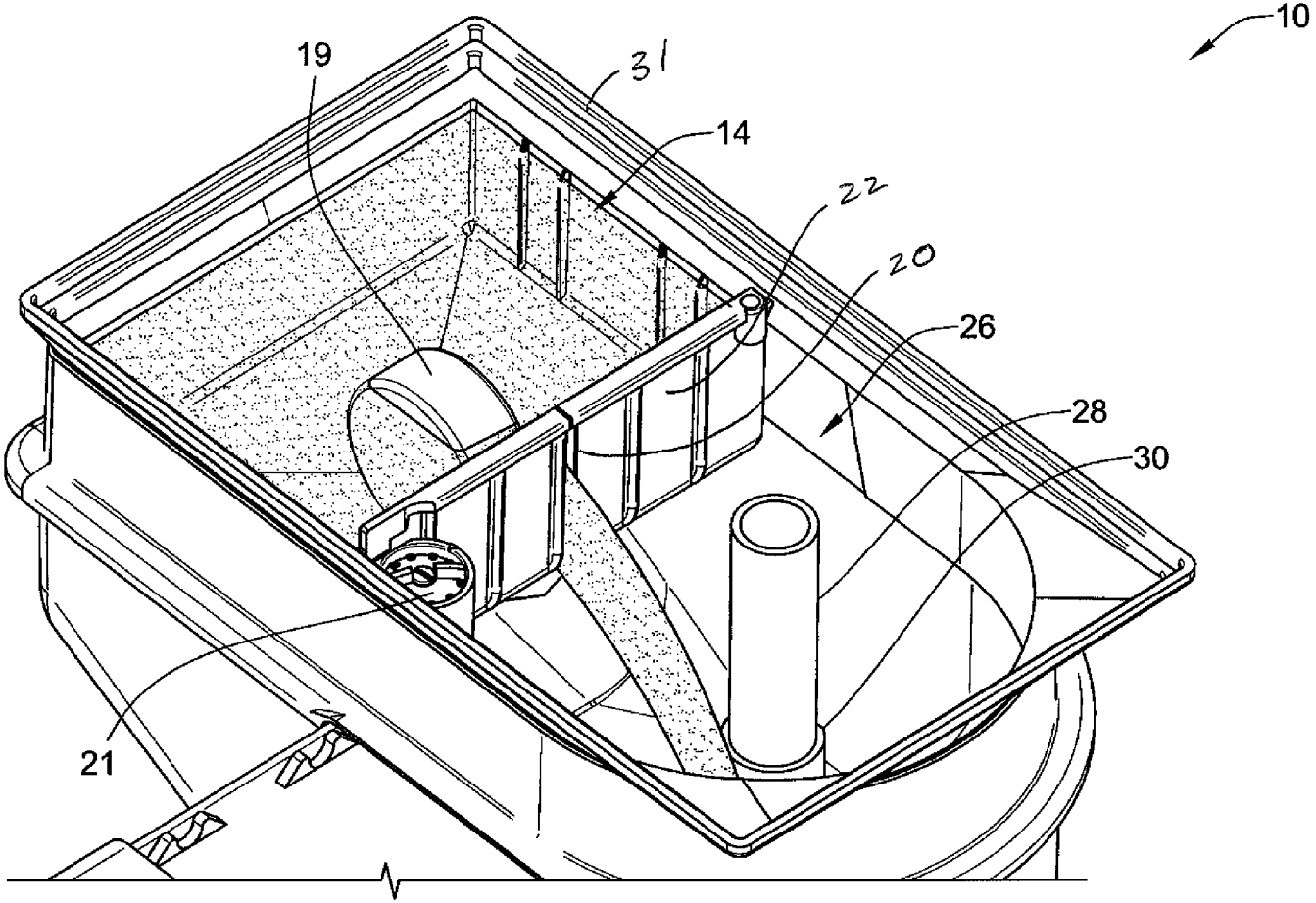
FIG. 9 is a perspective view of the overflow tube inserted in the receiving boss in the main skimmer chamber.
Figure 10:
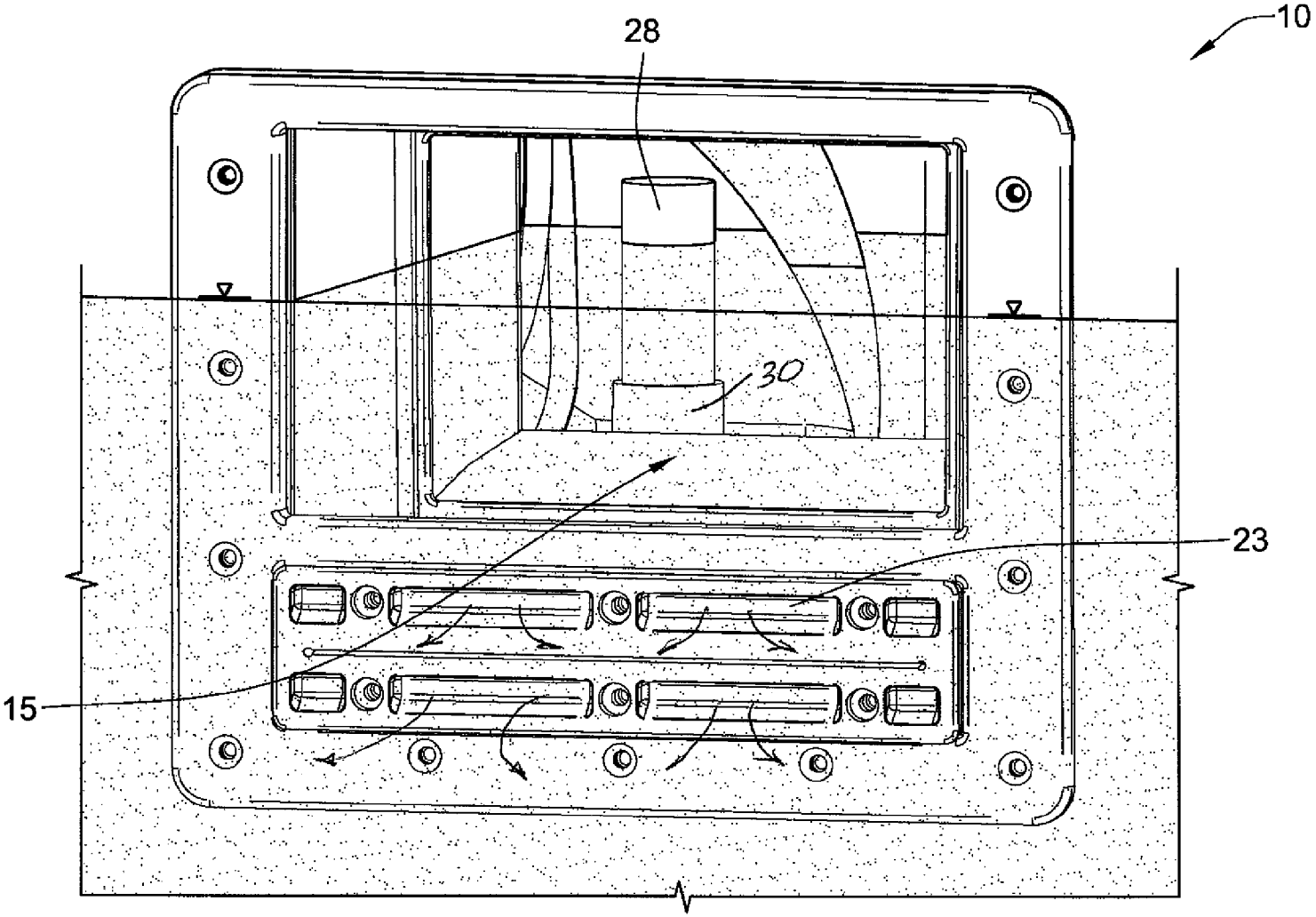
FIG. 10 is a view showing the overflow tube and the relationship to the normal water level of the skimmer body.

With the flow control valve 18 set to a lower number (i.e. 1-3 on the dial) a low rate of water flow will enter the disinfectant chamber 14, as shown in FIG. 6. With a small rate of incoming water flow, the water level within the disinfectant chamber 14 is very shallow. Since the water level within the disinfectant chamber 14 is very low, only a very small area of the chlorine tablets 19 is exposed to the water within the chamber. Thus, the amount of chlorinated water entering the skimmer main chamber 24 is low.

With the flow control valve 18 is set to a higher number (i.e. 5-9 on the dial) a high rate of water flow will enter the disinfectant chamber 14. Since the flow slit 20 is fixed, the amount of water entering the disinfectant chamber 14 is greater than the flow exiting the chamber. As the water flow rate is increased the water level within the disinfectant chamber 14 rises causing a greater area of the chlorine tablets to be exposed yielding higher concentration of chlorine that enters the skimmer main chamber 24.

If the flow control valve 18 is turned off (i.e. set to 0) the water level within the disinfectant chamber 14 drops below the chlorine tablets 19 to allow the chlorine tablets to dry.

Figure 11:
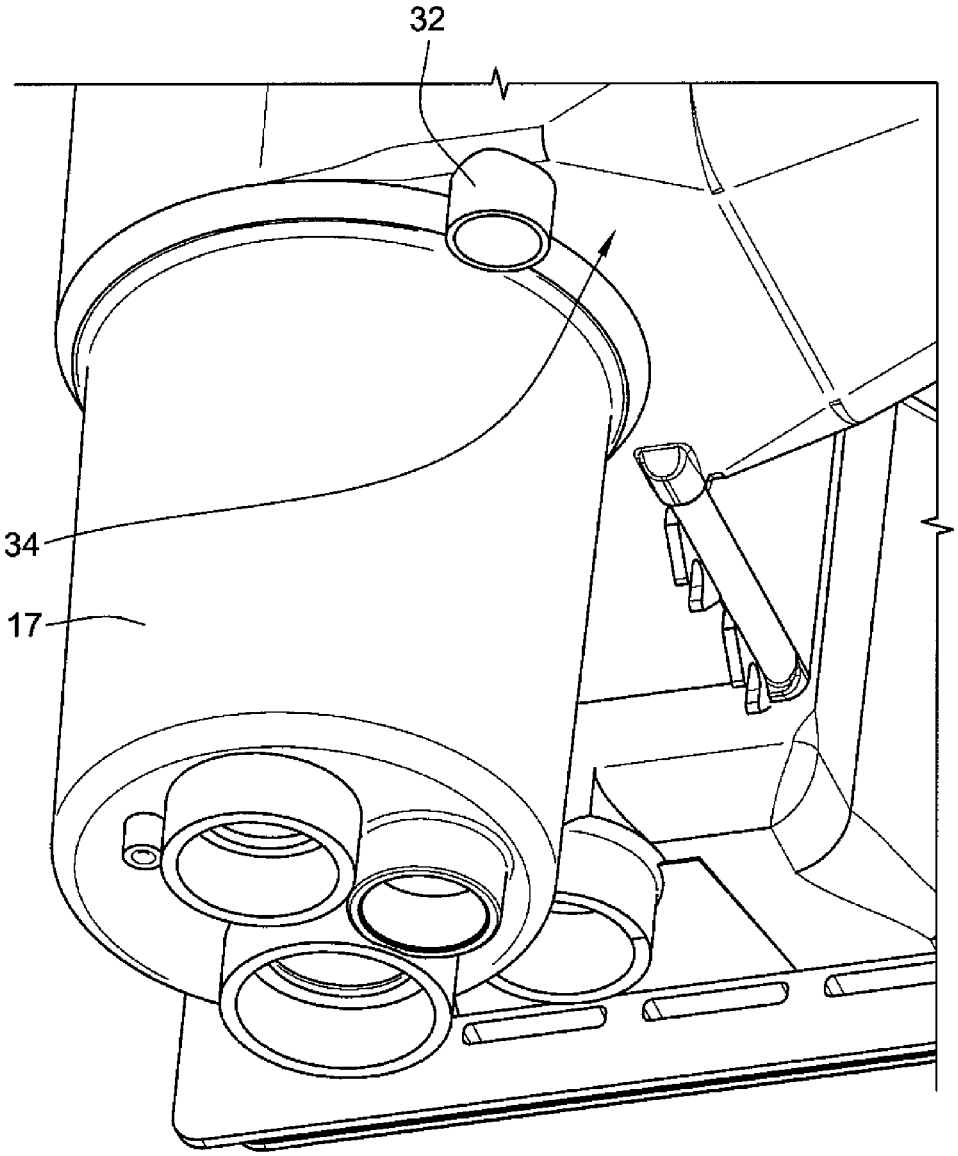
FIG. 11 is a perspective view of the receiver boss as it extends from the bottom side of the skimmer body.

Conventional skimmers have a horizontal overflow in a fixed location which do not allow for adjustment of the pool water level if required. Overflow 26 of the swimming pool skimmer 10 is positioned in a generally vertical orientation. As the overflow is placed in a vertical orientation the insertion of overflow tubes 28 of varying length allows for adjustment of the water level of the pool if required. The receiving boss 30 of the overflow tube 28 has a second receiving boss 32 on the bottom side of the skimmer body 34 to facilitate the connection to a drain line, as shown in FIG. 11.

Figure 12:
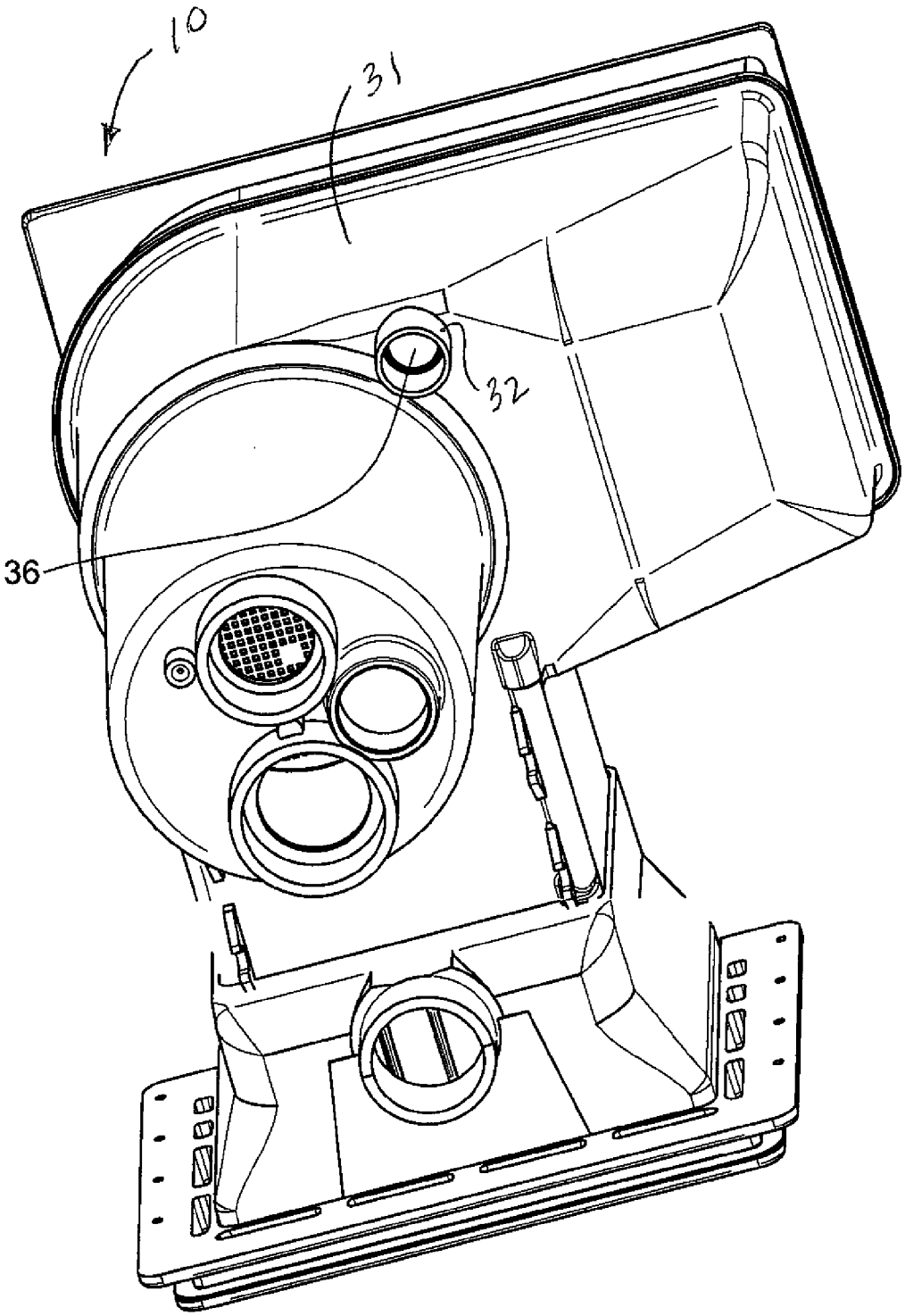
FIG. 12 is a perspective view of the break out feature of the overflow receiving boss.

The receiving boss 30 also has a wall section 36 called a breakout molded generally perpendicular to the axis of the receiving boss 30 and generally located at the mid point between the opening into the skimmer body and the second receiving boss opening to the outside of the skimmer body, as shown in FIG. 12. This wall has a section of decreased thickness around its perimeter where it joins the receiving boss interior wall.

If the overflow feature is not needed the tube is not inserted and the breakout is retained. If the overflow feature is required the breakout is removed creating a passage from the interior of the skimmer body and the second receiving boss and the overflow tube is inserted into the receiving boss which will allow water to flow out of the skimmer body once it rises over the exposed end of the overflow tube 28.

In operation water flows from the pressure chamber through the feed tube to the valve 18 and from the valve 18 the water is conveyed through the output tube (not shown) to the disinfectant chamber 14. The water dissolves the portion of the disinfectant material 19 which is then carried, as a solution, through the narrow return slit 20 in the disinfectant chamber 14 which is then added to the main flow of water through the body of the skimmer 10.

While embodiments have been illustrated and described in the drawings and foregoing description, such illustrations and description are considered to be exemplary and not restrictive in character, it being understood that only illustrative embodiments have been shown and described and that all changes and modifications that come within the spirit of the invention are desired to be protected. The applicants have provided description and figures which are intended as illustrations of embodiments of the disclosure, and are not intended to be construed as constraining or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

The invention claimed is:

1. A swimming pool skimmer for use with a swimming pool comprising:

a housing having an intake that receives water from the swimming pool, a filtration chamber containing a strainer, the intake being in fluid communication with the strainer, positioned downstream from the intake;

a plenum that is in fluid communication with the housing and returns pressurized water from a pump to the swimming pool;

a treatment system that includes a disinfectant chamber, which is configured to contain a treatment medium to condition the water, the disinfectant chamber configured to discharge conditioned water into the filtration chamber, the disinfectant chamber and filtration chamber separated by a generally vertical wall, the wall including a generally vertical slit to allow water from within the disinfectant chamber to pass to the filtration chamber;

a flow-control valve that is configured to adjust the flow of untreated water entering the disinfectant chamber wherein adjusting the valve to a first position causes the water level in the disinfectant chamber to rise, which increases the amount of water in contact with the treatment medium, and causes a first flowrate of water to exit the slit, and adjusting the valve to a second position causes the water level in the disinfectant chamber to drop, which decreases the amount of water in contact with the treatment medium, and causes a second flowrate of water to exit the slit that is less than the first flowrate of water, wherein the flow-control valve includes a tubular housing and a rotary dial having indicia.

2. The swimming pool skimmer of claim 1, wherein the disinfectant chamber forms part of the housing.

3. The swimming pool skimmer of claim 1, wherein the housing includes a main chamber.

4. The swimming pool skimmer of claim 3, wherein treated water exits the flow slit and enters the skimmer main chamber.

5. The swimming pool skimmer of claim 1, wherein the dial of the flow-control valve controls the flow of water through the flow-control valve by increasing or decreasing the cross-sectional area of a water flow path within the flow-control valve.

6. A swimming pool skimmer for use with a swimming pool comprising:

a housing having an intake that receives water from the swimming pool, a filtration chamber containing a strainer, the intake being in fluid communication with the strainer, positioned downstream from the intake;

a plenum that is in fluid communication with the housing and returns pressurized water from a pump to the swimming pool;

a treatment system integrally formed with the housing, the treatment system is provided with a disinfectant chamber that is configured to contain a treatment medium that is used to condition the water, the disinfectant chamber provided with a generally vertical wall positioned between the disinfectant chamber and the filtration chamber, the wall having a generally vertical drainage passageway to allow water from within the disinfectant chamber to be discharged into the filtration chamber at a controlled rate;

a flow-control valve that is configured to adjust the flow of untreated water entering the disinfectant chamber wherein adjusting the valve to a first position causes the water level in the disinfectant chamber to rise to a first level, which increases the amount of water in contact with the treatment medium, and causes a first flowrate of water to exit the drainage passageway, and adjusting the valve to a second position causes the water level in the disinfectant chamber to drop to a second level, which decreases the amount of water in contact with the treatment medium, and causes a second flowrate of water to exit the drainage passageway that is less than the first flowrate of water, wherein the flow-control valve includes a tubular housing and a rotary dial having indicia.

7. The swimming pool skimmer of claim 6, wherein the disinfectant chamber forms part of the housing.

8. The swimming pool skimmer of claim 7, wherein the drainage passageway is in the form of a vertical slit formed in a wall of the disinfectant chamber.

9. The swimming pool skimmer of claim 6, wherein the dial of the flow-control valve controls the flow of water through the flow-control valve by increasing or decreasing the cross-sectional area of a water flow path within the flow-control valve.

* * * * *